US005387088A

United States Patent [19]

Knapp et al.

[11] Patent Number: 5,387,088

[45] Date of Patent: Feb. 7, 1995

[54] PERISTALTIC PUMP TUBE LOADING ASSEMBLY

[75] Inventors: Tracey E. Knapp, Hanover; James R. Loible, Foxborough; Andrew P. Lanciano, Plymouth; Victor Sacco, Jr., Burlington, all of Mass.; Nicholas D. Baruch, North Smithfield, R.I.

[73] Assignee: Haemonetics Corporation, Braintree, Mass.

[21] Appl. No.: 183,483

[22] Filed: Jan. 18, 1994

[51] Int. Cl.[6] ..... F04B 43/08

[52] U.S. Cl. ..... 417/53; 417/477.1

[58] Field of Search ..... 417/474–477, 417/477 R

[56] References Cited

U.S. PATENT DOCUMENTS

| | | | |
|---|---|---|---|
| 4,221,543 | 9/1980 | Cosentino et al. | 417/22 |
| 4,472,116 | 9/1984 | Wenstrup | 417/477 |
| 4,500,269 | 2/1985 | Jess | 418/45 |
| 4,527,323 | 7/1985 | Dawson | 29/451 |
| 4,545,744 | 10/1985 | Weber et al. | 417/475 |
| 4,548,553 | 10/1985 | Ferster | 417/477 |
| 4,586,882 | 5/1986 | Tseng | 417/477 |
| 4,606,710 | 8/1986 | Maguire | 417/477 |
| 4,705,464 | 11/1987 | Arimond | 417/477 |
| 4,720,249 | 1/1988 | Krebs et al. | 417/477 |
| 4,824,339 | 4/1989 | Bainbridge | 417/477 |
| 4,861,242 | 8/1989 | Finsterwald | 417/477 |
| 4,925,376 | 5/1990 | Kahler | 417/477 |
| 5,190,448 | 3/1993 | Lane et al. | 417/474 |
| 5,249,938 | 10/1993 | Hall | 417/476 |

*Primary Examiner*—Richard E. Gluck
*Assistant Examiner*—Peter Korytnyk
*Attorney, Agent, or Firm*—Cesari and McKenna

[57] ABSTRACT

A peristaltic pump assembly for easy loading includes a pump housing having a curved surface. A stationary tubing manifold from which a loop of tubing extends is positioned in line with the curved surface. A pump rotor rotatable about an axis is positioned adjacent to the curved surface. The rotor has a groove located above the curved surface encircling the rotor for retaining and stretching the loop of tubing in loading position between the rotor and the manifold. During loading, a notch located on the rotor progressively captures and urges the tubing downward between the curved surface and the pump rotor when the rotor is rotated.

17 Claims, 4 Drawing Sheets

PERISTALTIC PUMP TUBE LOADING ASSEMBLY

BACKGROUND

Peristaltic pump assemblies for use with disposable tubing require the loading of the tubing into the peristaltic pump between a platen and a rotor before use. The rotor is positioned relative to the platen such that rollers located on the periphery of the rotor can intermittently and progressively compress the tubing against the platen to pump fluids through the tubing. In such an arrangement, the space between rollers of the rotor and the platen is less than the diameter of the tubing so that the tubing must be squeezed between the rollers and the platen when loaded into the pump.

One common method of loading the tubing into the pump is to hand-feed the tubing with one hand while hand-rotating the rotor with the other hand. A tool, protrusion or notch located on the rotor may be employed to urge the tubing between the platen and the rollers as the rotor is hand rotated. A problem with hand-feeding the tubing into a peristaltic pump is that both hands must be employed, making the procedure cumbersome.

A less cumbersome approach for loading tubing between the rollers of the rotor and the platen of a peristaltic pump is to either retract the rollers away from the platen or retract the platen away from the rotor with a spring loaded retracting mechanism. This increases the distance between the rollers and the platen to a distance greater than the diameter of the tubing so that the tubing can be easily loaded. A problem with this approach is that a retracting mechanism adds to the cost and complexity of the pump due to an increased number of parts.

Another approach employed for loading tubing within a peristaltic pump is disclosed in U.S. Pat. No. 4,861,242. A loop of tubing extending from a manifold cartridge is loaded into the peristaltic pump by engaging the tubing with a tab which urges the tubing between the platen and the rollers of the rotor while at the same time lowering the loop of tubing with a motor driven linear actuator from an elevation above the platen to an elevation in line with the platen. The upper portion of the rollers have a smaller diameter conical section to cause the tubing to be self-aligning at the larger diameter portion of the rollers. This approach is complex and costly.

SUMMARY OF THE INVENTION

Accordingly, there is a need for a simple and inexpensive peristaltic pump into which tubing is easily loaded.

The present invention provides a peristaltic pump assembly including a loop of tubing. A pump housing having a curved surface is positioned adjacent to the tubing manifold. A pump rotor rotatable about an axis for progressively and intermittently compressing the loop of tubing against the curved surface is positioned adjacent to the curved surface. The pump rotor has a first portion extending beyond the housing concentrically along the longitudinal axis and a second portion extending along the longitudinal axis adjacent to the curved surface. The rotor has a groove encircling the rotor above the curved surface. The groove retains the loop of tubing in a loading position above the curved surface. A notch on the rotor between the groove and the curved surface progressively captures the tubing and urges it downward between the curved surface and the pump rotor when the rotor is rotated during loading.

In preferred embodiments, a tubing mount secures the tubing to the pump housing at the same elevational level as the curved surface. The loop of tubing passes through a pair of slots in the pump housing. The notch includes a leading edge having an angled upper surface and a following edge having an angled lower surface. The pump rotor includes at least one constant diameter roller for intermittently and progressively compressing the loop of tubing against the curved surface. A bushing encircling the groove reduces friction between the tubing and the rotor.

The present invention peristaltic pump assembly provides a simple and inexpensive apparatus having a minimum number of parts into which tubing is easily loaded. The tubing can be loaded single-handedly with one rotation of the rotor by hand or can be loaded automatically by rotating the rotor with a motor drive.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENT

Figure 1:
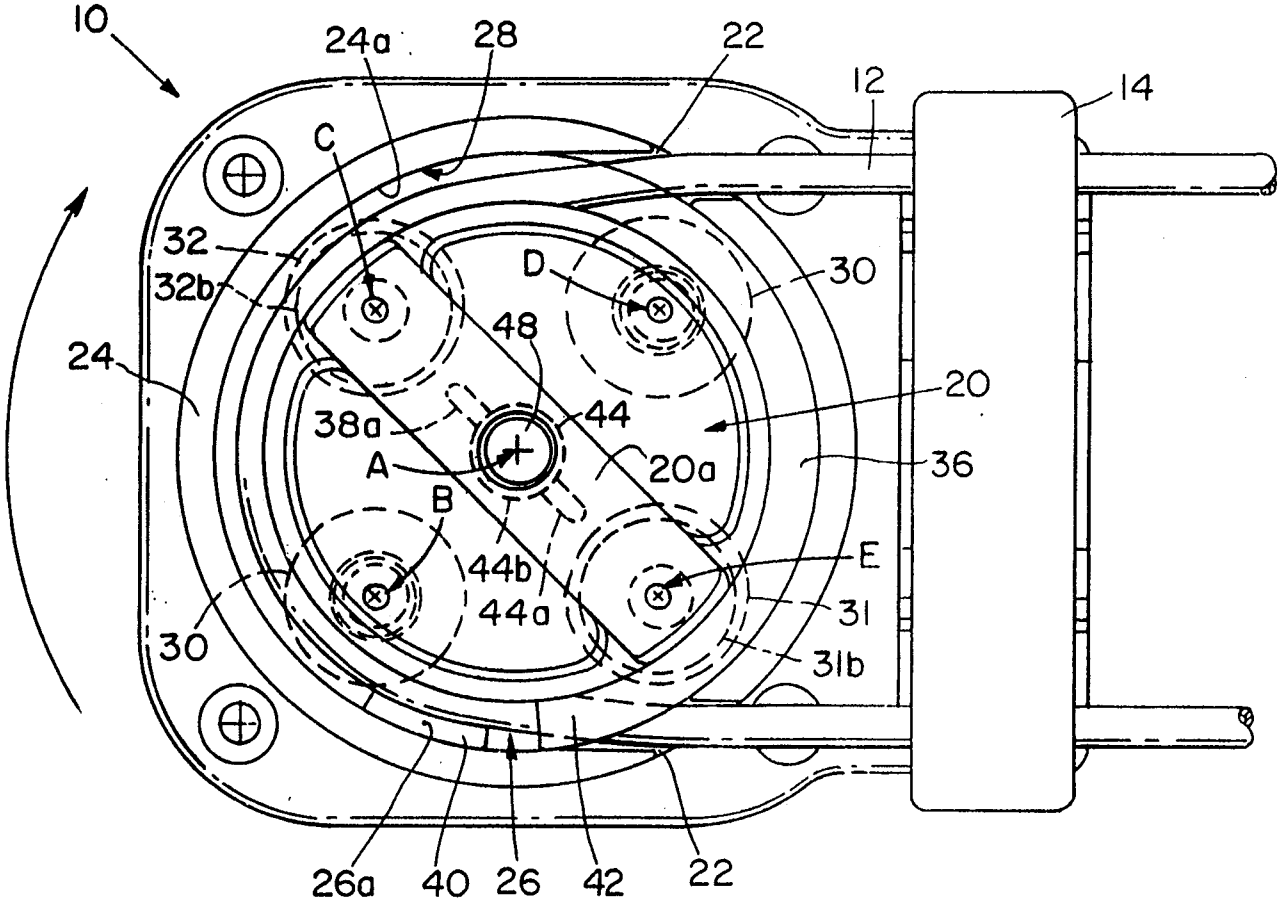
FIG. 1 is a top view of the present invention peristaltic pump assembly.
Figure 2:
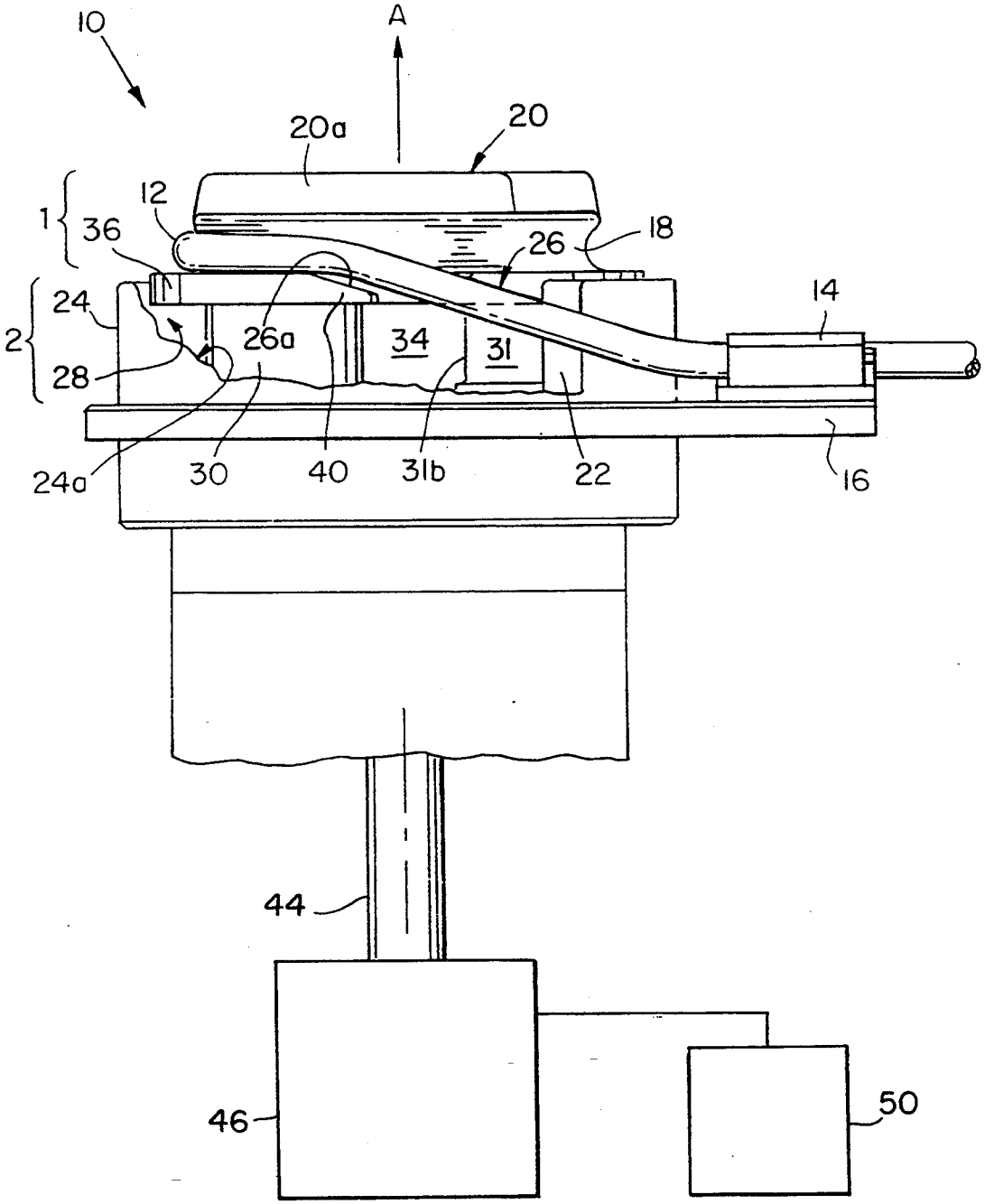
FIG. 2 is a side view of the present invention peristaltic pump assembly.

In FIGS. 1 and 2, peristaltic pump assembly 10 has a pump housing 24 and a stationary tubing manifold 14 located adjacent to each other. Manifold 14 is secured adjacent to pump housing 24 by a manifold mount 16. A loop of tubing 12 for loading into pump 10 extends from manifold 14. A pump rotor 20 rotatable about a longitudinal axis "A", is positioned within pump housing 24. The pump rotor 20 has a first portion 1 extending beyond the housing 24 concentrically along the longitudinal axis and a second portion 2 extending along the longitudinal axis adjacent to the curved surface 24*a*. Rotor 20 has a pair of drive rollers 30 and a pair of guide rollers 31 and 32 symmetrically positioned about the periphery of rotor 20 and rotatable about respective axes "B", "C", "D", and "E" concentric with axis "A".

A groove 18 encircles rotor 20 above upper flange 36. Groove 18 extends radially inward and retains tubing 12 on rotor 20 to place tubing 12 in position for loading within pump 10. A notch 26 is located on upper flange 36 between the outer periphery of flange 36 and groove 18. Notch 26 progressively captures and urges tubing 12 downward within pump 10 between rollers 30 and 32 and the inner curved surface 24*a* of pump housing 24 during loading. Slots 22 located on the sides of pump housing 24 allow tubing 12 to pass through and enter pump housing 24.

When tubing 12 is loaded into pump 10, rollers 30 intermittently and progressively compress tubing 12 against the inner surface 24*a* of pump housing 24 while rotor 20 is rotated, to pump fluids through tubing 12. The portion of inner surface 24*a* against which tubing 12 is compressed by rollers 30 between slots 22 serves as the platen or pumping region 28 of pump 10. Guide rollers 31 and 32 are positioned on rotor 20 preferably equidistant from rollers 30. Guide rollers 31 and 32 have recessed surfaces 31*b* and 32*b* which mate with tubing 12 to maintain the tubing 12 in the proper position.

In operation, to load tubing 12 into pump 10, tubing 12 is first placed over rotor 20 and into groove 18. Tubing manifold 14 is then secured in place on manifold mount 16. This locates manifold 14 in line or at the same elevational level as pumping region 28. In the preferred embodiment, manifold 14 is snapped into place but alternatively can be secured by any other suitable methods such as with a keyway. This stretches tubing 12 at an upward angle from manifold 14 to groove 18 which positions tubing 12 in loading position above the pumping region 28. Rotor 20 is then rotated in a clockwise direction such that the notch 26 in upper flange 36 progressively captures and pulls tubing 12 from groove 18 forcing tubing 12 downward, thereby urging the tubing between pumping region 28 and rollers 30, 31 and 32. Rotor 20 can be rotated by hand or can be automatically driven by motor 46. In the alternative, manifold 14 can be first secured to manifold mount 16 with tubing 12 then being stretched over rotor 20 to be retained in groove 18.

During automated loading, rotor 20 is driven by a drive shaft 44 coupled to a motor 46. Drive shaft 44 is inserted into bore 44*b* within rotor 20. A screw 48 within counterbored hole 48*a* (FIG. 4) secures rotor 20 to drive shaft 44. Drive shaft 44 has a pin 44*a* extending from both sides of drive shaft 44 which engages slot 38*a* located on the bottom of rotor 20. Alternatively, other suitable methods can be used to secure drive shaft 44 to rotor 20.

Motor 46 is preferably a servo or stepper motor and is controlled by computer 50. Computer 50 can be programmed to rotate drive motor and rotor 20 for one revolution in order to automatically load tubing 12 within pump 10. Although drive shaft 44 is shown to be coupled directly to motor 46, a gear reducer can be employed. Additionally, other suitable types of motors can be used to drive rotor 20.

Figure 3:
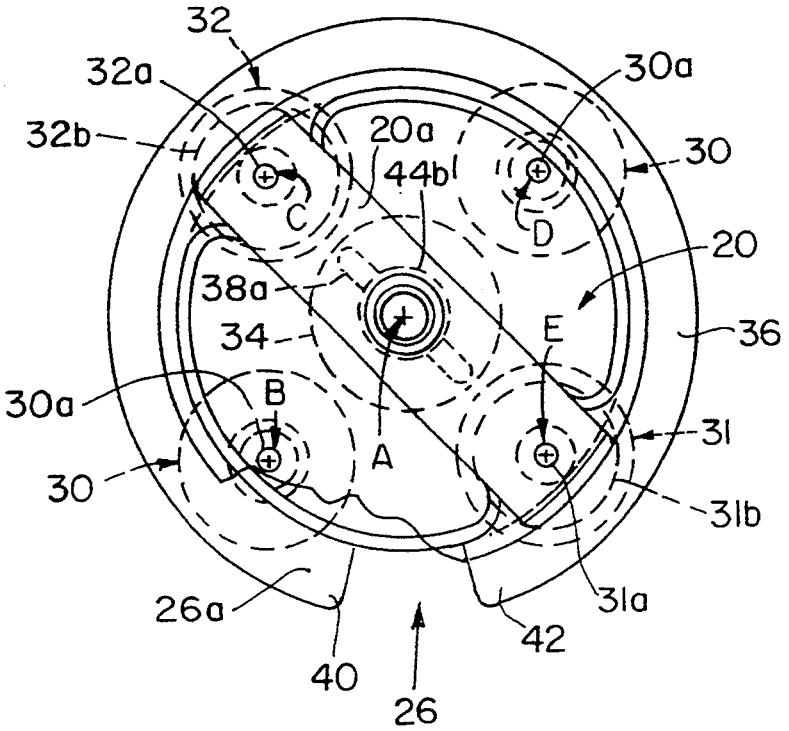
FIG. 3 is a top view with a broken away section of the rotor.
Figure 4:
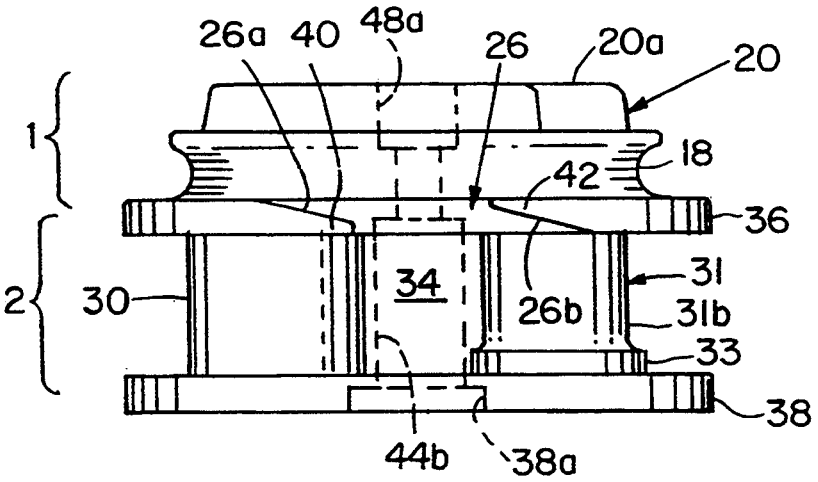
FIG. 4 is a side view of the pump rotor.

Referring to FIGS. 3 and 4, rotor 20 has a handle portion 20*a* which enables hand rotation of rotor 20. Groove 18 is located between the handle portion 20*a* and top flange 36. Groove 18 has a radius that is approximately the same as tubing 12. Rotor 20 and groove 18 are coated with a hard coating (such as an anodized coating) impregnated with polytetrafluorolethylene (PTFE) to reduce friction with tubing 12. Alternatively, groove 18 can be impregnated with other friction reducing materials and can be of other suitable retaining configurations such as a vee shape. Additionally, protrusions on rotor can be employed for retaining tubing 12 instead of groove 18. Notch 26 is located along the edge of top flange 36. Notch 26 has a leading edge 40 and a following edge 42. Leading edge 40 has an angled top surface 26*a* and following edge 42 has an angled lower surface 26*b* to smoothly capture and urge tubing 12 downwards. Central hub 34 connects lower flange 38 to upper flange 36.

Figure 5:
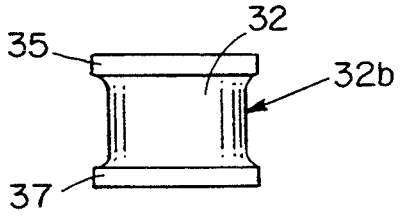
FIG. 5 is a side view of a guide roller.

Rollers 30, 31 and 32 are positioned concentric about axis "A" about respective axes "B", "C", "D" and "E" between upper flange 36 and lower flange 38. In the preferred embodiment, rollers 30, 31 and 32 are spaced equidistant from each other, but alternatively can be spaced differently. Roller 31 has a flange 33 located below recessed surface 31*b* to help guide tubing 12 but does not have a flange at the top of roller 31. By omitting a top flange on roller 31, tubing 12 can be loaded easily without binding on roller 31 and reduces the torque required to rotate rotor 20 during loading. In contrast, roller 32 (FIG. 5) has flanges 35 and 37 located at the top and bottom of roller 32. Tubing 12 does not bind on the upper flange 35 because tubing 12 is already loaded into pump 10 by the time roller 32 is rotated into position to engage tubing 12. Rollers 30, 31 and 32 are rigidly secured to rotor 20 by roller pins 30*a*, 31*a* and 32*a* respectively. In the preferred embodiment, rollers 30, 31 and 32 rotate on bushings about roller pins 30*a*, 31*a* and 32*a*. However, alternatively, other suitable types of bearings can be employed such as needle bearings, roller bearings and ball bearings.

In the preferred embodiment, rollers 30 have a resilient coating which is preferably a 60 durometer urethane coating. Alternatively, the resilient coating can be of other suitable polymers. The resilient coating compensates for tolerance variations of the pump components. This allows rollers 30, 31 and 32 to have fixed centers about roller pins 30*a*, 31*a* and 32*a* instead of employing a spring loaded platen or rollers for compensating for tolerance variations. Additionally, the use of urethane rollers reduces the torque required to drive rotor 20 with approximately a 50% reduction in drive motor current. Urethane rollers also operate more quietly than steel rollers and allows the use of non-precision tubing. Urethane does not wear out the tubing quickly and provides consistent pump displacement on long procedures. Alternatively, the exterior surface of rollers 30 can be of other suitable materials such as steel, aluminum or rigid polymers.

Figure 6:
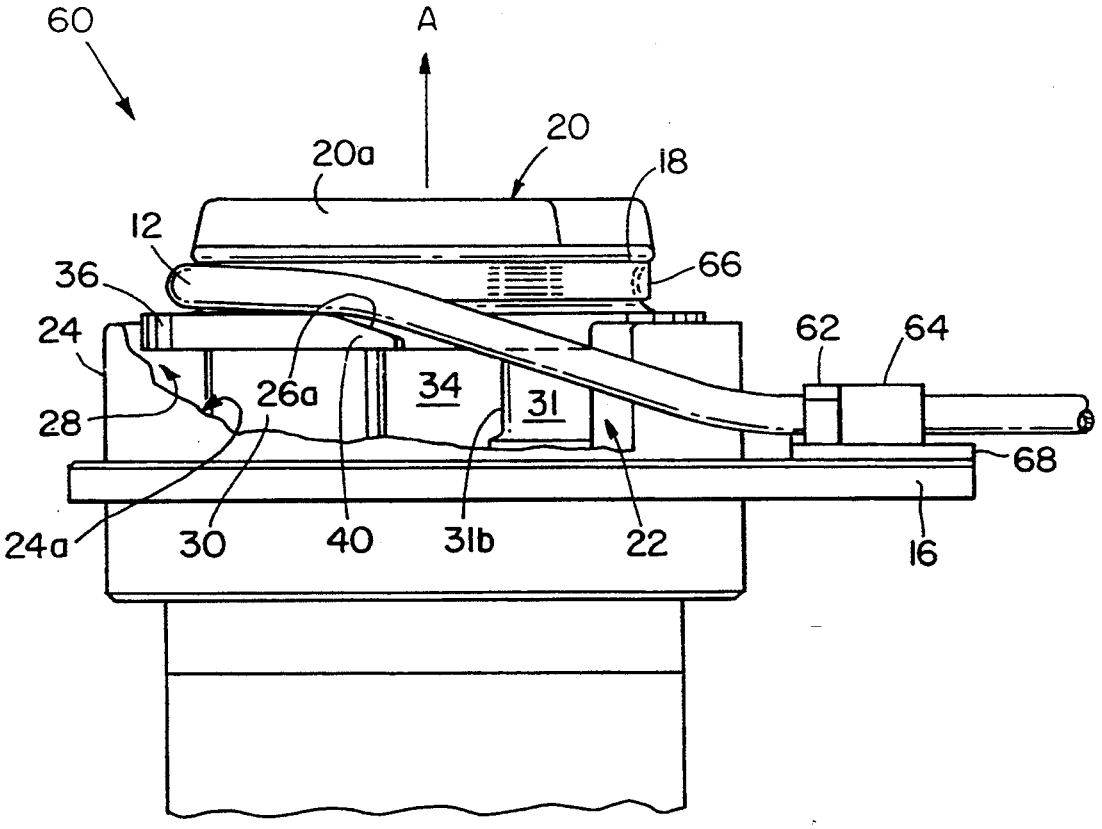
FIG. 6 is a side view of another preferred peristaltic pump assembly.

FIG. 6 depicts pump assembly 60 which is another preferred embodiment of the present invention. Pump assembly 60 operates in a similar manner to pump assembly 10. Pump assembly 60 includes a bushing 66 encircling rotor 20 about groove 18. The inner diameter of bushing 66 is greater than the diameter of groove 18 such that there is enough clearance between groove 18 and bushing 66 to allow bushing 66 to spin freely. In the preferred embodiment, bushing 66 has a radiused inner surface which mates with groove 18. Alternatively, the radiused surface can be omitted. Additionally, bushing 66 is preferably made of a polymer such that delrin. However, other suitable polymers can be used such as teflon and nylon as well as other materials such as bronze or brass.

Bushing 66 is positioned within groove 18 by stretching bushing 66 over rotor 20. A heat gun may be employed to help expand bushing 66. Rotor 20 may be made in two or more pieces so that bushing 66 can be assembled more easily about groove 18.

The use of bushing 66 minimizes friction between tubing 12 and rotor 20. As a result, when tubing 12 is automatically loaded into pump 60, the torque required to turn rotor 20 and load tubing 12 is minimized.

Tubing 12 is secured to pump housing 24 at the same elevational level as pumping region 28 by two tubing clips 62 rather than with a manifold. Tubing 12 squeezes into tubing clips 62 through slots located at the top of the clips. Two tubing stops 64 bonded to tubing 12 prevent tubing 12 from sliding through tubing clips 62. The base 68 of tubing clip 62 is secured to manifold mount 16. Alternatively, tubing clips 62 can be formed integral with pump housing 24.

EQUIVALENTS

While this invention has been particularly shown and described with references to preferred embodiments thereof, it will be understood by those skilled in the art that various changes in form and details may be made therein without departing from the spirit and scope of the invention as defined by the appended claims. For example, dual pump assemblies and dual manifold assemblies can be employed.

What is claimed is:

1. A peristaltic pump assembly comprising:

a loop of tubing;

a pump housing having a curved surface; and a pump rotor extending along and rotatable about a longitudinal axis for progressively and intermittently compressing the loop of tubing against the curved surface, the pump rotor having a first portion extending beyond the housing along the longitudinal axis and concentric thereto and a second portion extending along the longitudinal axis adjacent to the curved surface of the housing, with a groove formed in the first rotor portion and a flange provided between the groove and second rotor portion, said groove encircling the rotor about the first rotor portion for retaining the loop of tubing opposite the curved surface, a notch in the flange extending between the groove and the second rotor portion which, as the rotor is rotated during loading, progressively captures the tubing to urge it downward between the curved surface and the second portion of the rotor.

2. The peristaltic pump assembly of claim 1 wherein the loop of tubing passes through a slot in the pump housing.

3. The peristaltic pump assembly of claim 1 further comprising a manifold mount for securing the tubing to the pump housing at the same elevational level as the curved surface.

4. The peristaltic pump assembly of claim 1 in which the notch includes a leading edge having an angled upper surface and a following edge having an angled lower surface.

5. The peristaltic pump assembly of claim 1 in which the second portion of the pump rotor further comprises a constant diameter roller for intermittently and progressively compressing the loop of tubing against the curved surface.

6. The peristaltic pump assembly of claim 1 further comprising a bushing encircling the groove for reducing friction between the tubing and the rotor.

7. A peristaltic pump assembly comprising:

a loop of tubing;

a pump housing having a curved surface; and a pump rotor extending along and rotatable about a longitudinal axis for progressively and intermittently compressing the loop of tubing against the curved surface, the pump rotor having a first portion extending beyond the housing along the longitudinal axis and concentric thereto and a second portion extending along the longitudinal axis adjacent to the curved surface of the housing, the second portion including a constant diameter roller, a groove formed in the first rotor portion and a flange provided between the groove and second rotor portion, said groove encircling the rotor about the first rotor portion above the curved surface for retaining the loop of tubing opposite the curved surface, a notch in the flange extending between the groove and the second rotor portion which, as the rotor is rotated during loading, progressively captures the tubing to urge it downward between the curved surface and the second portion of the rotor.

8. The peristaltic pump assembly of claim 7 wherein the loop of tubing passes through a slot in the pump housing.

9. The peristaltic pump assembly of claim 7 further comprising a manifold mount for securing the tubing to the pump housing at the same elevational level as the curved surface.

10. The peristaltic pump assembly of claim 7 in which the notch includes a leading edge having an angled upper surface and a following edge having an angled lower surface.

11. The peristaltic pump assembly of claim 7 further comprising a bushing encircling the groove for reducing friction between the tubing and the rotor.

12. A method of loading tubing between a curved surface of a pump housing and a pump rotor extending beyond the housing along a longitudinal axis in a peristaltic pump, the pump rotor having a first portion extending along the longitudinal axis and concentric thereto and a second portion extending along the longitudinal axis adjacent to the curved surface of the housing, the method comprising the steps of:

retaining a loop of tubing opposite the curved surface with a groove formed in the first rotor portion, a flange being provided between the groove and the second portion, said groove encircling the pump rotor about the first rotor portion above the curved surface; and rotating the pump rotor about the longitudinal axis to progressively capture the tubing with a notch in the flange extending between the groove and the second rotor portion to urge it downward between the curved surface and the second portion of the rotor.

13. The method of claim 12 further comprising the step of securing the tubing to the pump housing at the same elevational level as the curved surface with a tubing mount.

14. The method of claim 12 further comprising the step of providing slots in the pump housing for passing the loop of tubing through the pump housing.

15. The method of claim 12 in which the notch includes a leading edge having an angled upper surface and a following edge having an angled lower surface.

16. The method of claim 12 in which the second portion of the pump rotor has a constant diameter roller for intermittently and progressively compressing the loop of tubing against the curved surface.

17. The method of claim 12 further comprising the step of reducing friction between the tubing and the rotor with a bushing encircling the groove.

* * * * *